US008629343B2

(12) United States Patent
Wakai et al.

(10) Patent No.: US 8,629,343 B2
(45) Date of Patent: Jan. 14, 2014

(54) COMPUTER-READABLE STORAGE MEDIUM HAVING STORED THEREIN INFORMATION PROCESSING PROGRAM, INFORMATION PROCESSING APPARATUS, INFORMATION PROCESSING SYSTEM, AND INFORMATION PROCESSING METHOD

(75) Inventors: Hajime Wakai, Kyoto (JP); Masato Mizuta, Kyoto (JP)

(73) Assignee: Nintendo Co., Ltd., Kyoto (JP)

( * ) Notice: Subject to any disclaimer, the term of this patent is extended or adjusted under 35 U.S.C. 154(b) by 39 days.

(21) Appl. No.: 13/414,272

(22) Filed: Mar. 7, 2012

(65) Prior Publication Data

US 2013/0118336 A1 May 16, 2013

(30) Foreign Application Priority Data

Nov. 15, 2011 (JP) ..... 2011-249778

(51) Int. Cl.
*G10H 3/00* (2006.01)

(52) U.S. Cl.
USPC ..... 84/611; 84/635; 84/651; 84/667

(58) Field of Classification Search
USPC ..... 84/600–603, 611, 635, 651, 667
See application file for complete search history.

(56) References Cited

U.S. PATENT DOCUMENTS

| | | | | |
|---|---|---|---|---|
| 8,097,801 | B2 * | 1/2012 | Gannon | 84/613 |
| 8,178,770 | B2 * | 5/2012 | Kobayashi | 84/613 |
| 8,420,921 | B2 * | 4/2013 | Kobayashi | 84/613 |
| 2004/0019475 | A1 * | 1/2004 | Bloom et al. | 704/1 |
| 2007/0199431 | A1 * | 8/2007 | Kashioka | 84/612 |
| 2008/0034947 | A1 * | 2/2008 | Sumita | 84/613 |
| 2008/0034948 | A1 * | 2/2008 | Sumita | 84/636 |
| 2008/0115656 | A1 * | 5/2008 | Sumita | 84/612 |
| 2008/0184869 | A1 * | 8/2008 | Smith et al. | 84/609 |
| 2009/0064848 | A1 * | 3/2009 | Henkel | 84/483.2 |
| 2009/0223350 | A1 | 9/2009 | Osada | |
| 2011/0132172 | A1 * | 6/2011 | Gueneux | 84/454 |
| 2011/0226117 | A1 | 9/2011 | Osada | |
| 2012/0011988 | A1 * | 1/2012 | Hara et al. | 84/613 |
| 2012/0101606 | A1 * | 4/2012 | Miyajima | 700/94 |
| 2012/0137855 | A1 * | 6/2012 | Gannon | 84/613 |
| 2013/0000466 | A1 * | 1/2013 | Taub et al. | 84/609 |
| 2013/0118336 | A1 * | 5/2013 | Wakai et al. | 84/609 |

FOREIGN PATENT DOCUMENTS

JP 2009-210917 9/2009

* cited by examiner

*Primary Examiner* — David S. Warren
(74) *Attorney, Agent, or Firm* — Nixon & Vanderhye P.C.

(57) ABSTRACT

An example computer of an information processing apparatus that reproduces music composed of one or more tracks is caused to function as: a reproduction section configured to reproduce the music; a meter change section configured to change the meter for reproduction of the music, while the reproduction section is reproducing the music; and a determination section configured to, based on the meter that has been changed, repeatedly determine whether or not to cause the reproduction section to reproduce the next beat supposed to be reproduced in a bar of the music that is currently being reproduced. The reproduction section reproduces the music, based on the result of the determination by the determination section.

15 Claims, 6 Drawing Sheets

COMPUTER-READABLE STORAGE MEDIUM HAVING STORED THEREIN INFORMATION PROCESSING PROGRAM, INFORMATION PROCESSING APPARATUS, INFORMATION PROCESSING SYSTEM, AND INFORMATION PROCESSING METHOD

CROSS REFERENCE TO RELATED APPLICATION

The disclosure of Japanese Patent Application No. 2011-249778, filed on Nov. 15, 2011, is incorporated herein by reference.

FIELD

The exemplary embodiments relate to a computer-readable storage medium having stored therein an information processing program, an information processing apparatus, information processing system, and an information processing method, and more specifically, to a computer-readable storage medium having stored therein an information processing program, an information processing apparatus, information processing system, and an information processing method, that reproduce music.

BACKGROUND AND SUMMARY

Conventionally, a music performing apparatus for reproducing music data composed of a plurality of tracks, or a music performing program executed by such a music performing apparatus is known.

However, such conventional music performing programs cannot change the meter for reproduction of music during processing (reproduction) of music data.

Therefore, a feature of the exemplary embodiments provides a computer-readable storage medium having stored therein an information processing program, an information processing apparatus, information processing system, and an information processing method that are novel and capable of changing the meter of music. Another feature of the exemplary embodiments provides a computer-readable storage medium having stored therein an information processing program, an information processing apparatus, information processing system, and an information processing method that are capable of changing the meter of music in real time even during reproduction of a middle part of a bar of the music.

The exemplary embodiments have the following aspects in order to solve the above problem.

One aspect of the exemplary embodiments is a computer-readable storage medium having stored therein an information processing program which is executed by a computer of an information processing apparatus that reproduces music composed of one or more tracks. The information processing program causes the computer to function as: a reproduction section configured to reproduce the music; a meter change section configured to change the meter for reproduction of the music, while the reproduction section is reproducing the music; and a determination section configured to, based on the meter that has been changed, repeatedly determine whether or not to cause the reproduction section to reproduce the next beat supposed to be reproduced in a bar of the music that is currently being reproduced. The reproduction section reproduces the music, based on the result of the determination by the determination section.

According to the above aspect, the meter change section changes the meter for reproduction of music, and the determination section determines whether or not the next beat supposed to be reproduced in the current bar (i.e., the beat just after a beat that has currently been reproduced) is to be reproduced, based on the changed meter. That is, whether or not the next beat of music is to be reproduced is determined on a beat-by-beat basis in a bar in accordance with the changed beat. Thus, even when a middle part of a bar of music is being reproduced, reproduction of the music can be adjusted on a beat-by-beat basis in accordance with the changed beat, in real time.

In another aspect, the music may include a first meter track and a second meter track, and the reproduction section may conduct the reproduction as follows. If the meter changed by the meter change section is a first meter, the reproduction section may reproduce the first meter track with sound and reproduce the second meter track without sound. If the meter changed by the meter change section is a second meter which is different from the first meter, the reproduction section may reproduce the first meter track without sound and reproduce the second meter track with sound.

According to the above aspect, the first meter track and the second meter track are reproduced in parallel. At this time, if the meter for reproduction of music is the first meter, the second meter track is reproduced without sound. If the meter for reproduction of music is the second meter, the first meter track is reproduced without sound. Thus, a user can hear only the sound of a track corresponding the meter for reproduction of music. In addition, since these two tracks are reproduced in parallel, the position of reproduction of the current bar or beat does not differ between these two tracks. Here, in the case where, at the timing when the meter has been changed, reproduction of a track currently being reproduced is stopped, and reproduction of another track that had been stopped until then is started, there is a possibility that the music sounds unnatural because of the difference between the timings of the switching. However, according to the above aspect, such a problem does not occur. In addition, it is not necessary to adjust such timings of the meter changing so as to match them.

In another aspect, the second meter track may be a track generated by adjusting the same melody as that of the first meter track so as to correspond to the second meter.

According to the above aspect, since the second meter track has a melody adjusted based on the melody of the first meter track, it is possible to provide music to a user without feeling of strangeness, in accordance with the meter for reproduction of the music.

In another aspect, the number of the first meter may be larger than the number of the second meter.

According to the above aspect, the second meter track is the one that has been adjusted so as to correspond to the second meter which is smaller than the first meter. That is, if the first meter is the maximum meter of possible meters to which the meter may be changed, the second meter track, whose meter is smaller than the first meter, can be generated based on the first meter track.

In another aspect, if the result of the determination by the determination section is negative, the reproduction section may not reproduce the next beat supposed to be reproduced, and if the result of the determination by the determination section is positive, the reproduction section may reproduce the next beat supposed to be reproduced.

According to the above aspect, whether or not the next beat supposed to be reproduced is to be reproduced is determined in accordance with the result of the determination. Thus, even when a middle part of a bar of music is being reproduced, reproduction of the music can be adjusted on a beat-by-beat basis.

In another aspect, the determination section may conduct the determination as follows. If the number of the next beat supposed to be reproduced in a bar is equal to or smaller than the number of the meter changed by the meter change section, the determination section may determine to cause the reproduction section to reproduce the next beat supposed to be reproduced. If the number of the next beat supposed to be reproduced in a bar is larger than the number of the meter changed by the meter change section, the determination section may determine not to cause the reproduction section to reproduce the next beat supposed to be reproduced.

According to the above aspect, the number of the next beat supposed to be reproduced in a bar is compared with the number of the meter, for reproduction of the music, which has been changed by the meter change section. Then, whether or not the next beat supposed to be reproduced is to be reproduced is determined in accordance with the result of the comparison. Specifically, for example, in the case where the changed meter for reproduction of the music is triple meter, if the next beat supposed to be reproduced in a bar is the third beat, the third beat is reproduced, but if the next beat supposed to be reproduced in a bar is the fourth beat, the fourth beat is not reproduced. Thus, even when a middle part of a bar of music is being reproduced, reproduction of the music can be adjusted on a beat-by-beat basis in accordance with the changed beat, in real time.

In another aspect, if the result of the determination by the determination section is negative, the reproduction section may start to reproduce the first beat in the next bar.

According to the above aspect, if the next beat supposed to be reproduced in a bar is not reproduced, the first beat in the next bar is reproduced. Specifically, for example, in the case where the number of the changed meter for reproduction of the music is three (triple meter), if the next beat supposed to be reproduced in a bar is the third beat, the third beat is reproduced, but if the next beat supposed to be reproduced in a bar is the fourth beat, the fourth beat is not reproduced and the first beat in the next bar is reproduced. That is, by using the same music, it is also reproduced as music in triple meter. Therefore, if one piece of music data whose number of beats (for example, four beats) per bar corresponds to the maximum meter to which the meter may be changed is prepared, the music can be reproduced in each of a plurality of beats (in quadruple meter or smaller meter). In the case where several tracks that have been adjusted so as to correspond to respective predetermined meters are prepared, these tracks are reproduced in parallel while reproduction thereof is switched between reproduction with sound and reproduction without sound in accordance with the changed meter. Therefore, the meter for reproduction is smoothly switched, whereby the music can be prevented from sounding unnatural.

In another aspect, the determination section may repeatedly conduct the determination at a predetermined interval.

According to the above aspect, whether or not the next beat supposed to be reproduced (the beat just after the current beat) is to be reproduced can be periodically determined at an appropriate timing.

In another aspect, the predetermined interval may be equal to or shorter than the interval between predetermined beats in bars.

According to the above aspect, in a determination process, if, for example, the meter for reproduction of music is changed from quadruple meter to triple meter, whether or not the fourth beat (the beat just after the current beat) is to be reproduced is determined just before reproduction of the fourth beat in each bar (i.e., every four beats). Thus, whether or not the beat just after the current beat is to be next reproduced can be determined in an appropriate timing, based on the number of the changed meter, whereby an efficient determination process can be realized.

In another aspect, when the meter is switched between the first meter and the second meter by the meter change section, the reproduction section may switch reproduction of each of the first meter track and the second meter track between reproduction with sound and reproduction without sound, by cross-fading.

According to the above aspect, reproduction of each of the first meter track and the second meter track is switched between reproduction with sound and reproduction without sound, by cross-fading. As a result, a user hardly feels strangeness when tracks are switched being reproduced with sound.

In another aspect, the information processing program may further cause the computer to function as: an input accepting section configured to accept an input from a user. The meter change section may change the meter for reproduction of the music data, based on the input from the user accepted by the input accepting section.

According to the above aspect, the meter for reproduction of music can be changed in accordance with an instruction inputted from a user.

In another aspect, the input from the user accepted by the input accepting section may be used for processing other than the processing of changing the meter for reproduction of the music data.

According to the above aspect, for example, when processing of operating a game character (processing other than the processing of changing the meter for reproduction of music data) is executed based on an input from a user (game player), the situation or the scene of a game can be changed, and in accordance with the change, the meter for reproduction of music can be changed.

In the above, the exemplary embodiments are described using a computer-readable storage medium having stored therein an information processing program, as an example. However, the exemplary embodiments may be applied to an information processing apparatus, an information processing system, or an information processing method.

According to the exemplary embodiments, it is possible to provide a computer-readable storage medium having stored therein an information processing program, an information processing apparatus, information processing system, and an information processing method that are novel and capable of changing the meter of music. In addition, it is possible to provide a computer-readable storage medium having stored therein an information processing program, an information processing apparatus, information processing system, and an information processing method that are capable of changing the meter of music in real time even during reproduction of a middle part of a bar of the music.

These and other objects, features, aspects and advantages of the exemplary embodiments will become more apparent from the following detailed description when taken in conjunction with the accompanying drawings.

DETAILED DESCRIPTION OF NON-LIMITING EXAMPLE EMBODIMENTS

Embodiment

Hereinafter, with reference to the drawings, an embodiment will be described. In the present embodiment, an information processing system will be used as an example. However, the exemplary embodiments are not limited to such an information processing system. An information processing apparatus that realizes the function of such an information processing system, an information processing method executed by such an information processing apparatus, or a computer-readable storage medium having stored therein an information processing program executed by such an information processing apparatus, may be used.

(Hardware Configuration of Information Processing System)

Figure 1:
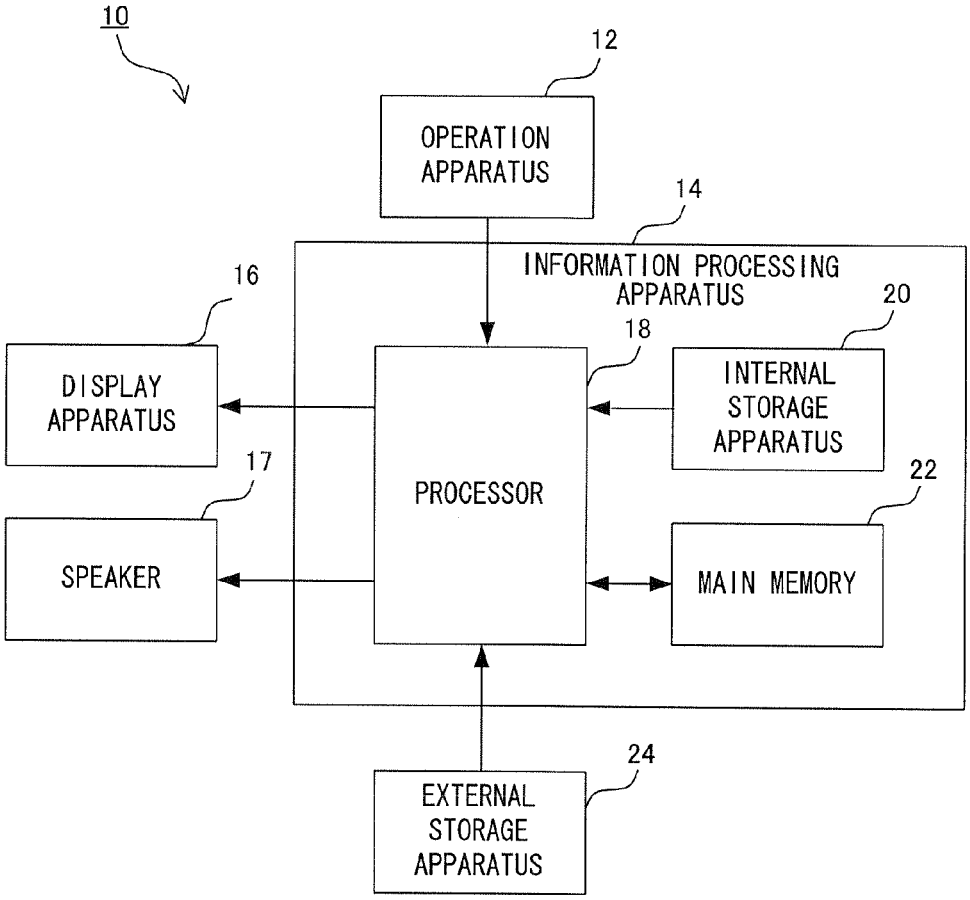
FIG. 1 is a block diagram showing a non-limiting example of the configuration of an information processing system 10.

With reference to FIG. 1, an information processing system 10 according to the present embodiment will be described. FIG. 1 is a block diagram showing a non-limiting example of the configuration of the information processing system 10. As shown in FIG. 1, the information processing system 10 includes an operation apparatus 12, an information processing apparatus 14, a display apparatus 16, a speaker 17, and an external storage apparatus 24.

The operation apparatus 12 is an input apparatus for giving operation data to the information processing apparatus 14, the operation data indicating an operation performed for the operation apparatus 12. The operation apparatus 12 and the information processing apparatus 14 may be connected by using wireless communication technique, or may be connected by wire, e.g., a connection cord.

The information processing apparatus 14 includes a processor 18, an internal storage apparatus 20, and a main memory 22. The internal storage apparatus 20 has stored therein a computer program executed by the processor 18. Typically, the internal storage apparatus 20 is a hard disk or a ROM (Read Only Memory). The main memory 22 temporarily stores a computer program or other data.

The display apparatus 16 displays an image generated by the information processing apparatus 14 on a screen. It is noted that the display apparatus 16 may be integrated with the information processing apparatus 14.

The speaker 17 outputs sound generated by the information processing apparatus 14. It is noted that the speaker 17 may be integrated with the display apparatus 16.

The external storage apparatus 24 stores a computer program executed by the processor 18. Typically, the external storage apparatus 24 is a CD (Compact Disc), a DVD (Digital Versatile Disc), or a semiconductor storage device.

It is noted that the above-described hardware configuration is merely an example. The exemplary embodiments are applicable to any information processing system.

Hereinafter, as an example, it will be assumed that the information processing system 10 of the present embodiment is a game system. In the information processing system 10 of the present embodiment, the information processing apparatus 14 (for example, a game apparatus) executes a game process or a music reproduction process, based on an operation performed for the operation apparatus 12 (for example, a game controller).

First, the music reproduction process for reproducing game music (an example of pieces of music), which is executed in the information processing system 10, will be described. In the present embodiment, the processor 18 executes a music reproduction program (an example of computer programs) for reproducing game music which is loaded from the external storage apparatus 24 or the like to the main memory 22, whereby game music is reproduced in accordance with progression of a game.

(Music Reproduction Process)

In the present embodiment, music data of game music to be reproduced by the music reproduction program is based on MIDI (Musical Instruments Digital Interface) standard (such data may be also referred to as MIDI data). The MIDI data is loaded from the external storage apparatus 24 or the like to the main memory 22. In MIDI data, a plurality of notes included in the music are managed with one or more tracks (which correspond to a musical score). That is, each note of the music belongs to one of the tracks.

The MIDI data is represented as a set of a plurality of MIDI events. MIDI events include various MIDI events, for example, a "note event" for reproducing a sound, and a "control change event" for changing the volume or the tone color of sounds on a track-by-track basis, and moreover, a "pitch bend event", a "program change event", and the like. A combination of event information and time information indicating time intervals between MIDI events are stored in occurrence order, thus forming MIDI data.

The note event includes information about a "corresponding track", a "reproduction timing", a "note length (duration)", a "pitch (note number)", a "velocity" and the like. The "corresponding track" is information indicating which track a note reproduced by the note event belongs to. The "reproduction timing" is information indicating a timing to reproduce a note, which is represented by unit of tick. The "note length (duration)" is information indicating the length of a sound of the note, which is represented by tick. The "pitch (note number)" is information indicating the pitch of a sound. The "velocity" is information indicating the intensity of reproduction of a sound.

The music reproduction program executes various MIDI events including note events, in order from the top, based on MIDI data of music, thereby sequentially reproducing the music in accordance with the order of bars and the order of beats. More specifically, sound data generated by the information processing apparatus 14 executing the music reproduction program is outputted via the speaker 17. It is noted that an existing program library or the like that functions as a MIDI player may be used as the music reproduction program.

It is noted that the number of a beat (e.g., the third beat) indicates the position of reproduction in each bar. As used herein, "reproduction of a beat" means reproduction of a note included in the beat, unless otherwise noted.

By the way, game music is often used as dramatic or stage-effect music for acoustic effect of a game so that the interest or a sense of realism of the game will increase, in accordance with progression of the game. Therefore, it may be desired that the meter of game music is changed in accordance with the change in the scene or the situation of a game, whereby a sense of realism is increased. Specifically, when game music is being reproduced in a predetermined meter (for example, quadruple meter), if the situation (scene) of a player character (central character) of a game has changed (for example, the player character has moved to a rest station), the meter is changed (to triple meter, for example) without changing the melody of the game music, whereby a game player can feel the change in the situation of the player character with a sense of realism. Such change in situation can occur while a game player operates the player character by using the operation apparatus 12. Therefore, it is preferable that the meter of game music can be changed in real time at any timing (that is, even if a middle part of a bar of the game music is being reproduced). In the present embodiment, in order to achieve such purpose as described above, in execution of the MIDI events by the reproduction processing program, a determination process is periodically executed just before reproduction of a beat in each bar is started in accordance with a MIDI event. Hereinafter, the determination process of the present embodiment will be described.

(Determination Process)

The determination process of the present embodiment periodically compares the number of a meter for reproduction of game music with the number of the next beat supposed to be reproduced in each bar, and determines the next processing to be executed, in accordance with the result of the comparison (designates the next MIDI event to be executed by the reproduction processing program). The determination process is executed by the processor 18 executing a determination program loaded from the storage apparatus 20 or the like to the main memory 22.

Figure 2:
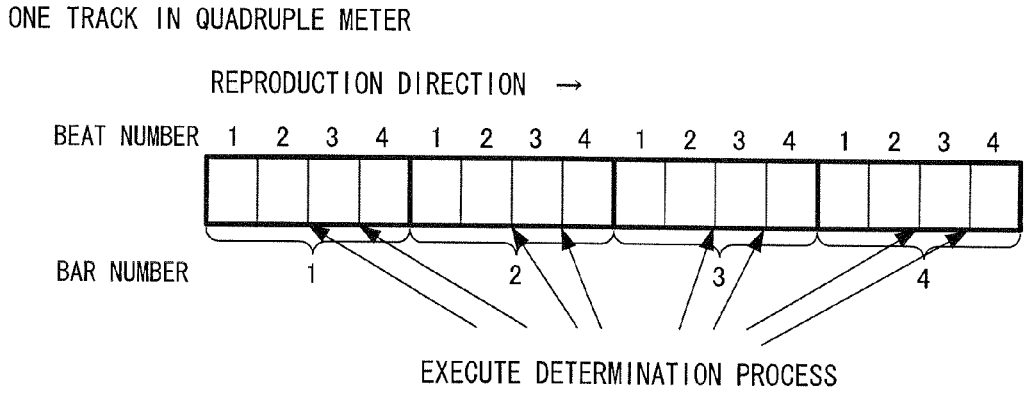
FIG. 2 is a schematic diagram showing a non-limiting example of music data.
Figure 3:
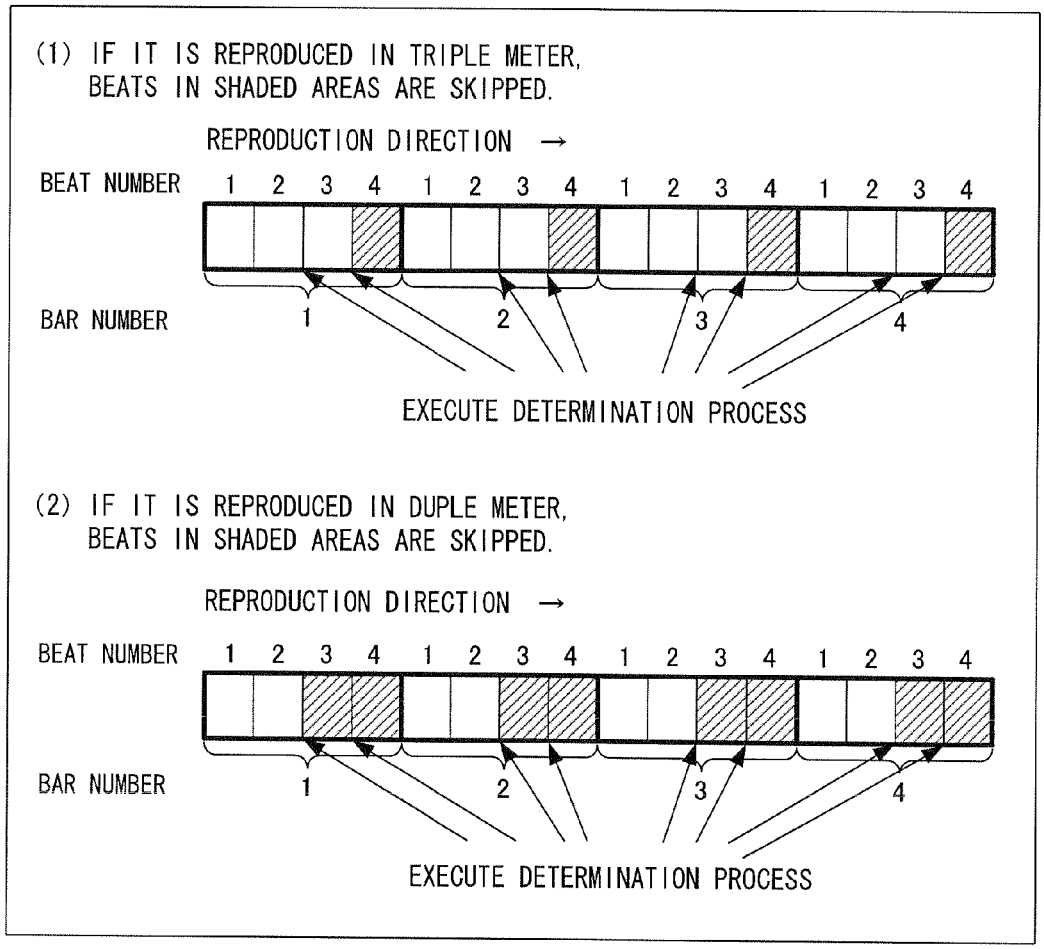
FIG. 3 is a schematic diagram showing a non-limiting example of music data in the case where the meter is changed.

Hereinafter, with reference to FIG. 2 and FIG. 3, the determination process will be specifically described. FIG. 2 is a schematic diagram showing a non-limiting example of music data of one track in quadruple meter. Part (1) of FIG. 3 is a schematic diagram showing reproduction, in triple meter, of music data of one track in quadruple meter. Part (2) of FIG. 3 is a schematic diagram showing reproduction, in duple meter, of music data of one track in quadruple meter.

As the music reproduction program sequentially executes various MIDI events included in MIDI data in order from the top, game music is sequentially reproduced in accordance with the order of bars and the order of beats. Specifically, if music data is composed of one track in quadruple meter, as shown in FIG. 2, the music data is executed (reproduced) in the order of the first beat, the second beat, the third beat, and then the fourth beat in the first bar, the first to fourth beats similarly in the second bar, and then beats in subsequent bars, thus being reproduced in accordance with the order of bars and the order of beats of the game music. Here, the determination process (determination program) is periodically executed, for the processing of the music data executed by the music reproduction program. By the execution of the determination program, the number n ("n" of the n-th beat) of the next beat supposed to be reproduced (that is, a beat supposed to be reproduced at the present), and the number R of a meter in which the game music is reproduced, are compared, and the next processing to be executed is determined based on the result of the comparison. Specifically, if the determination program has determined n≤R, it is determined that as the next processing, the next MIDI event is executed by the music reproduction program as normal. On the other hand, if the determination program has determined n>R, it is determined that as the next processing, instead of the next MIDI event, a MIDI event of reproducing the first beat in the next bar is executed by the music reproduction program (that is, processing for the remaining MIDI events included in the bar that is currently being reproduced is omitted).

An example of execution of the determination program described above will be specifically described with reference to FIG. 2 and FIG. 3. As shown in FIG. 2 and FIG. 3, if music data of one track in quadruple meter is reproduced in quadruple meter (R=4), triple meter (R=3), or duple meter (R=2), the determination program is periodically executed just before reproduction of the third beat (n=3) and just before reproduction of the fourth beat (n=4).

As shown in FIG. 2, if music data of one track in quadruple meter is reproduced in quadruple meter (R=4), just before reproduction of the third beat (n=3), the number of the next beat (that is, n=3) supposed to be reproduced, and the number of the meter for the reproduction of the game music (that is, R=4) are compared, and n≤R is determined. Therefore, as the next processing, the next MIDI event is executed by the music reproduction program as normal. Then, just before reproduction of the fourth beat (n=4), the number of the next beat (that is, n=4) supposed to be reproduced, and the number of the meter for the reproduction of the game music (that is, R=4) are compared, and n≤R is determined. Therefore, as the next processing, the next MIDI event is executed by the music reproduction program as normal. That is, the MIDI events are executed in accordance with its order, and the music data is reproduced in normal order (the music data is reproduced in quadruple meter).

On the other hand, as shown in Part (1) of FIG. 3, if music data of one track in quadruple meter is reproduced in triple meter (R=3), just before reproduction of the third beat (n=3), the number of the next beat (that is, n=3) supposed to be reproduced, and the number of the meter for the reproduction of the game music (that is, R=3) are compared, and n≤R is determined. Therefore, as the next processing, the next MIDI event is executed by the music reproduction program as normal. Then, just before reproduction of the fourth beat (n=4), the number of the next beat (that is, n=4) supposed to be reproduced, and the number of the meter for the reproduction of the game music (that is, R=3) are compared, and n>R is determined. Therefore, it is determined that as the next processing, a MIDI event of reproducing the first beat in the next bar is executed by the music reproduction program. Thus, the first beat in the next bar is executed without executing the remaining MIDI event (that is, without reproducing the fourth beat). That is, as shown in Part (1) of FIG. 3, the music data of one track in quadruple meter is reproduced while beats that are shaded areas (fourth beats) are skipped. As a result, music in triple meter is reproduced, the melody of the game music being kept.

By the way, as described above, since the meter for reproduction of music data in quadruple meter is changed in accordance with the change in situation caused by an operation of the player character by a game player, it is preferable that the beat can be changed in real time. In the present embodiment, information indicating in what meter the music data is to be reproduced is acquired every frame (which is much shorter than a period of one beat, for example, every 1/60 sec). Therefore, when a MIDI event of reproducing the third beat in a bar is being executed by the music reproduction program, if the meter for reproduction of the music is changed from quadruple meter to triple meter, the value of R will have already changed from 4 to 3 just before the fourth beat in the bar is reproduced. Therefore, here, if the above determination program is executed, a MIDI even of reproducing the fourth beat, which is the next beat, will not be executed (skipped). Thus, even when a middle part of a bar of the music data is being reproduced, the meter of the game music can be changed in real time.

Next, with reference to Part (2) of FIG. 3, the case where music data of one track in quadruple meter is reproduced in duple meter will be described. In this case, the determination program is periodically executed just before reproduction of the third beat (n=3) and just before reproduction of the fourth beat (n=4). Therefore, when a MIDI event of reproducing the first beat or a MIDI event of reproducing the second beat is being executed by the music reproduction program, if the meter for reproduction of the music data has been changed from quadruple meter to duple meter, just before reproduction of the third beat, the determination process program is executed whereby the number of the next beat supposed to be reproduced (that is, n=3) and the number of the meter for reproduction of the game music (that is, R=2) are compared. As a result, n>R is determined, and therefore it is determined that as the next processing, a MIDI event of reproducing the first beat in the next bar is executed by the music reproduction program. Thus, the first beat in the next bar is reproduced without executing the remaining MIDI events (that is, without reproducing the third beat and the fourth beat). That is, as shown in Part (2) of FIG. 3, music data of one track in quadruple meter is reproduced while beats that are shaded areas (third beats and fourth beats) are skipped. As a result, music in duple meter is reproduced, the melody of the game music being kept.

In addition, when a MIDI event of reproducing the third beat is being executed by the music reproduction program, if the meter for reproduction of the music data has been changed to duple meter, just before reproduction of the fourth beat, the determination process program is executed whereby the number of the next beat supposed to be reproduced (that is, n=4) and the number of the meter for reproduction of the game music (that is, R=2) are compared. As a result, n>R is determined, and therefore it is determined that as the next processing, a MIDI event of reproducing the first beat in the next bar is executed by the music reproduction program. Thus, the first beat in the next bar is executed without executing the remaining MIDI event (that is, without reproducing the fourth beat). In this way, if the meter for reproduction of music data is changed from quadruple meter to duple meter, the determination program is executed just before reproduction of the third beat and just before reproduction of the fourth beat, whereby, even when a middle part of a bar of the music data is being reproduced, the meter of the game music can be changed in real time.

It is noted that the timing of executing the determination program is not limited to the above example. For example, the determination program may be executed just before reproduction of every beat in each bar. Thus, it is possible to change the meter more flexibly in real time. In addition, if music data merely has, in each bar, beats corresponding to the maximum meter of possible meters to which the meter may be changed, the music data can support all the meters to which the meter may be changed, and therefore it is not necessary to separately prepare pieces of music data for respective meters.

Figure 4:
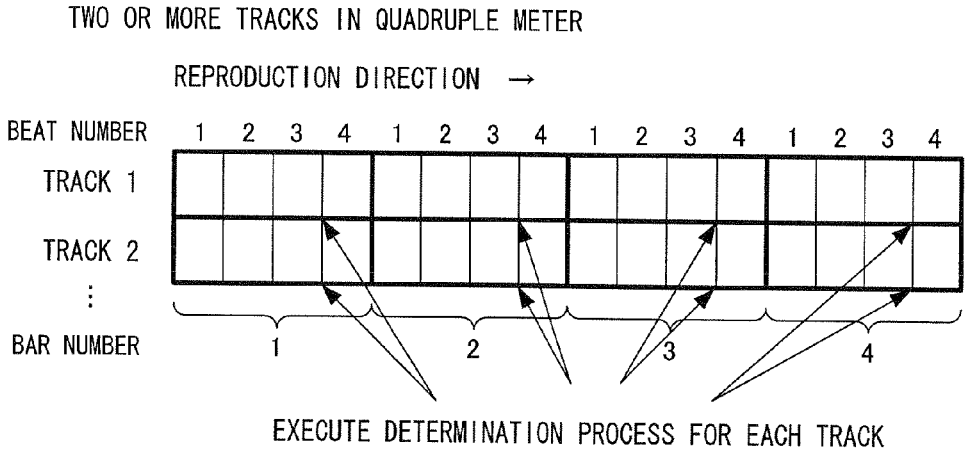
FIG. 4 is a schematic diagram showing a non-limiting example of music data composed of a plurality of tracks.

In the above description, music data is composed of one track, as an example. However, music data may be composed of a plurality of tracks. In this case, the determination program is executed at the same timing in each track. Specifically, as shown in FIG. 4, if music data composed of a plurality of tracks in quadruple meter is reproduced in triple meter (R=3), the determination program is executed at least just before reproduction of the fourth beat (n=4), in each track. As a result, n>R is determined in each track, and therefore, in each track, it is determined that the first beat in the next bar is to be reproduced. Then, the first beats in the next bars in the tracks are reproduced at the same timing. Thus, even if music data is composed of a plurality of tracks, even when a middle part of a bar of the music data is being reproduced, the meter of the game music can be changed in real time, as in the case where music data is composed of one track. It is noted that the determination program may be executed in one of the tracks, and based on the result of the determination, it may be determined that, for example, the fourth beats in all the tracks are not reproduced (the fourth beats are skipped):

As described above, the determination process is periodically executed, or more specifically, the determination process is executed just before reproduction of a beat that is a target of determination about whether or not to skip it, whereby the meter of music can be changed in real time. As a matter of course, it should be understood that after music data in quadruple meter is changed to triple meter, when the music data returns to quadruple meter, the value of R returns from 3 to 4. In this case, the determination process is executed just before the fourth beat (n=4), and n≤R is determined. Therefore, the remaining MIDI event is executed by the music reproduction program. Thus, the music data is reproduced in normal order, that is, the music data is reproduced as music in quadruple meter which is the original meter.

Next, various data (memory map) to be stored in the main memory 22 for execution of the music reproduction process and the determination process will be described.

(Memory Map)

Figure 5:
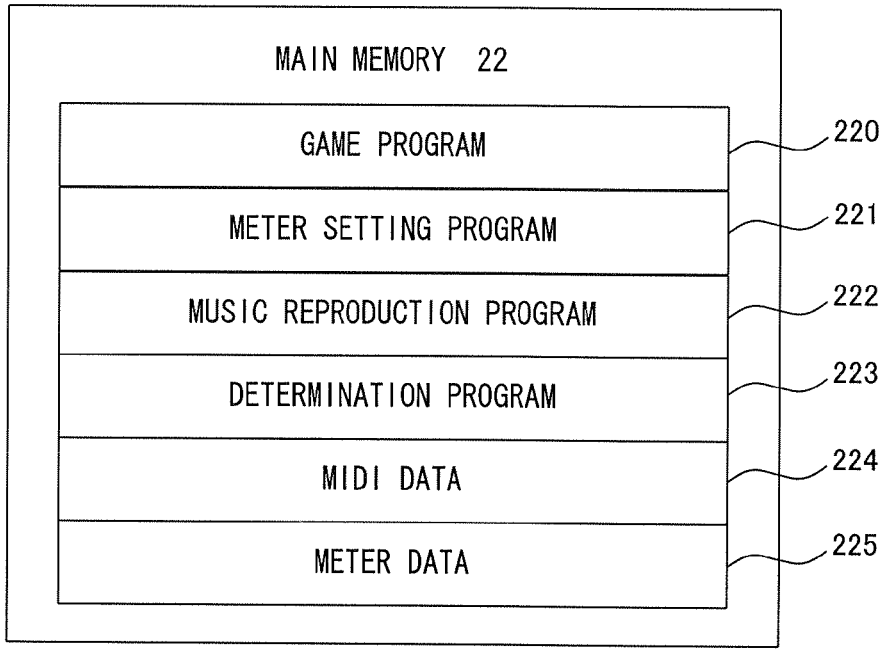
FIG. 5 shows a non-limiting example of the memory map of a main memory 22.

FIG. 5 shows a non-limiting example of the memory structure of the main memory 22 for storing various data or programs such as a game program loaded from the external storage apparatus 24 or the internal storage apparatus 20. As shown in FIG. 5, the main memory 22 includes a game program 220, a meter setting program 221, a music reproduction program 222, a determination program 223, MIDI data 224, and meter data 225. The game program 220, the meter setting program 221, the music reproduction program 222, and the determination program 223 are executed by the processor 18. In addition, the MIDI data 224 and the meter data 225 are used in execution of the meter setting program 221, the music reproduction program 222, or the determination program 223.

The game program 220 is a program for conducting a game, i.e., accepting operation information from the operation apparatus 12 about an operation by a game player (user), and conducting a game in accordance with the operation information.

The meter setting program 221 is a program for setting the meter of music (game music) to be reproduced by the music reproduction program 222 described later. Specifically, the meter setting program 221 is periodically executed, whereby the meter data 225 is updated as appropriate in accordance with the progression (situation) of a game.

The music reproduction program 222 is a program for reproducing music (game music) used for acoustic effect of a game, in accordance with the progression of the game executed by the game program 220. In the reproduction, music data (MIDI data 224) corresponding to the progression of the game is used.

The determination program 223 is a program for acquiring the meter data 225, periodically comparing the number of the meter indicated by the meter data 225, with the number of the next beat supposed to be reproduced, and determining the next processing in accordance with the result of the comparison.

The MIDI data 224 is data of game music used in execution of the music reproduction program. The MIDI data 224 is composed of a set of a plurality of MIDI events as described above.

The meter data 225 indicates the meter of music to be reproduced by the music reproduction program. Specifically, an initial value is set in advance for each piece of music. The meter data 225 is updated in accordance with the progression of a game by the meter setting program being executed. It is noted that the meter data 225 may be updated based on operation information by a game player.

Next, a flowchart of a meter setting process executed by the meter setting program 221 being executed will be described.

(Flowchart of Meter Setting Process)

Figure 6:
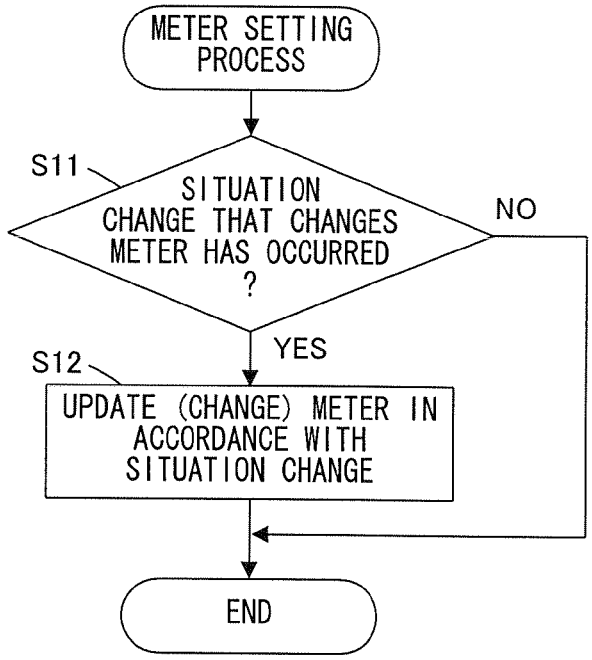
FIG. 6 is a flowchart showing a non-limiting example of a meter setting process.

With reference to FIG. 6, the meter setting process executed by the processor 18 of the information processing apparatus 14 will be described. FIG. 6 is a flowchart showing a non-limiting example of the meter setting process executed by the processor 18, according to the present embodiment. If the information processing apparatus 14 has been powered on, the processor 18 executes a boot program stored in a so-called boot ROM of the internal storage apparatus 20, to initialize the main memory 22. Various programs and various data are loaded from the external storage apparatus 24 or the like to the main memory 22. Then, the meter setting program 221 is read to execute the process of the flowchart shown in FIG. 6, every frame (for example, every 1/60 sec).

In step S11, the processor 18 determines whether or not to change the meter of music (that is, whether or not to update the meter data 225). Specifically, the processor 18 determines whether or not to update the meter data 225, based on the situation of a game conducted by the game program 220 being executed. For example, in accordance with change in the situation of the game, if the meter of the game music currently being reproduced as acoustic effect of the game is to be changed, the processor 18 determines that the meter data 225 is to be updated. If the result of the determination is YES, the process proceeds to step S12. If the result of the determination is NO, the process ends here, and the process of the flowchart shown in FIG. 6 is started again, at next frame.

In step S12, the processor 18 updates the meter data 225. Specifically, the processor 18 updates the meter of the music to an appropriate value in accordance with the situation of the game. For example, if a situation in which it is a relaxed time in a game space is to be created, the processor 18 updates the value of the meter data 225 of the game music for acoustic effect, from quadruple meter which has been used until then, to triple meter. The process ends here. At next frame, the process of the flowchart shown in FIG. 6 is started again.

As described above, the processor 18 updates the meter of the game music to an appropriate value, every frame, as appropriate in accordance with the situation of the game. Thus, the meter data 225 has been already updated to the latest value that is suitable to the situation of the game, at the timing when the determination program described later is executed.

Next, a flowchart of the determination process executed by the determination program 223 being executed will be described.

(Flowchart of Determination Process)

Figure 7:
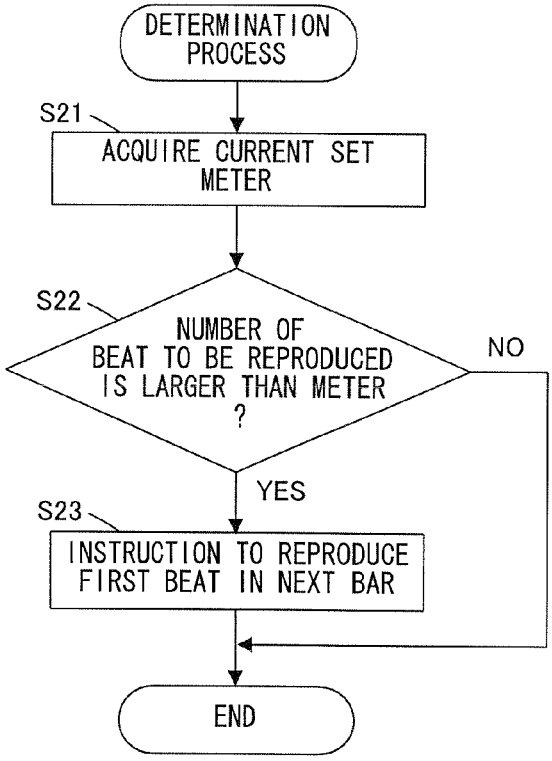
FIG. 7 is a flowchart showing a non-limiting example of a determination process.

With reference to FIG. 7, the determination process executed by the processor 18 of the information processing apparatus 14 will be described. FIG. 7 is a flowchart showing a non-limiting example of the determination process executed by the processor 18, according to the present embodiment. The information processing apparatus 14 is powered on, the main memory 22 is initialized, and then various programs and various data are loaded from the external storage apparatus 24 or the like to the main memory 22. Then, the processor 18 reads the determination program 223, thereby executing the process of the flowchart shown in FIG. 7 with a predetermined period (for example, at a timing just before the fourth beat in each bar is reproduced).

In step S21, the processor 18 refers to the meter data 225, and acquires the meter, for reproduction of music, that is currently set. Then, the process proceeds to step S22.

In step S22, the processor 18 determines whether or not the number of the next beat of the music supposed to be reproduced is larger than the number of the set meter for reproduction of the music. Specifically, the processor 18 compares the number n (the n-th beat) of the next beat of the music data supposed to be reproduced by the music reproduction program 222, with the number R of the meter for reproduction of the music acquired in step S21, and determines whether or not the number of the next beat supposed to be reproduced is larger than the number of the meter (n>R). If the result of the determination is YES, the process proceeds to step S23. If the result of the determination is NO, the process ends here. Thereafter, the process of the flowchart shown in FIG. 7 is executed again with a predetermined period.

In step S23, the processor 18 determines the first beat in the next bar of the game music to be the next beat that is to be reproduced by the music reproduction program 222. Specifically, the processor 18 determines to execute a MIDI event corresponding to reproduction of the first beat in the next bar by the music reproduction program 222, without executing the remaining MIDI event by the music reproduction program 222 (i.e., the processor 18 skips the remaining MIDI event). The process ends here. Thereafter, the process of the flowchart shown in FIG. 7 is executed again with a predetermined period.

Here, for example, if there is a possibility that music data in quadruple meter may be reproduced also in triple meter, the above predetermined period may be such that the determination process is periodically (repeatedly) executed at least just before reproduction of every fourth beat (see Part (1) of FIG. 3). In addition, for example, if there is a possibility that music data in quadruple meter may be reproduced also in duple meter, the above predetermined period may be such that the determination process is periodically (repeatedly) executed at least just before reproduction of every third beat and every fourth beat (see Part (2) of FIG. 3). In addition, if there is a possibility that one piece of music data may be reproduced in various meters, the above predetermined period may be such that the determination process is periodically (repeatedly) executed at least just before reproduction of every beat.

As described above, the processor 18 executes the determination process program with a predetermined period (for example, just before reproduction of the fourth beat in every bar), thereby comparing the number of the latest set meter of game music corresponding to the situation of a game, with the number of the next beat supposed to be reproduced, and based on the result of the comparison, determining whether to reproduce the next beat as normal or reproduce the first beat in the next bar (that is, instead of reproducing the next beat and the subsequent beats included in a bar that is currently being reproduced, reproduce the first beat in the next bar).

Thus, even when a beat at a middle part of a bar of music data is being reproduced, the meter of the music data can be changed in real time.

As described above, in the present embodiment, the determination process is repeatedly executed at an appropriate timing, whereby music is reproduced while a predetermined beat is skipped in accordance with change in the meter for reproduction of the music. Thus, it is possible to reproduce music in different meters by using the same piece of music data.

It is noted that the following methods may be used in order to realize smooth change in music when the meter of music data is changed. For example, if music data in quadruple meter is to be reproduced in triple meter, the music is reproduced while the fourth beat in each bar is skipped. In this case, the length of the note (the third beat in the bar) just before the fourth beat may be maintained around the fourth beat which is to be skipped. Alternatively, the length of the note (the third beat in the bar) just before the fourth beat may be set such that the length of the note will not overlap with the next note (the first beat in the next bar) to be reproduced. Alternatively, the next note (the first beat in the next bar) may be reproduced only if the note is not a rest.

Other than the above methods, the following method may be used in order to smoothly connect bars of music data when the meter of the music is changed. That is, a meter dedicated track in which notes are adjusted in advance so as to smoothly connect bars may be prepared for each meter. Hereinafter, a modification using such prepared meter dedicated tracks will be described.

(Modification)

Figure 8:
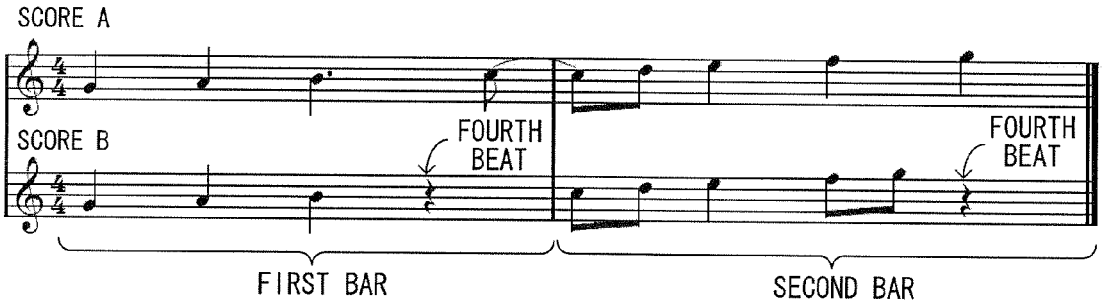
FIG. 8 shows a non-limiting example of musical scores for reproduction of a normal reproduction track and an alternative reproduction track.
Figure 9:
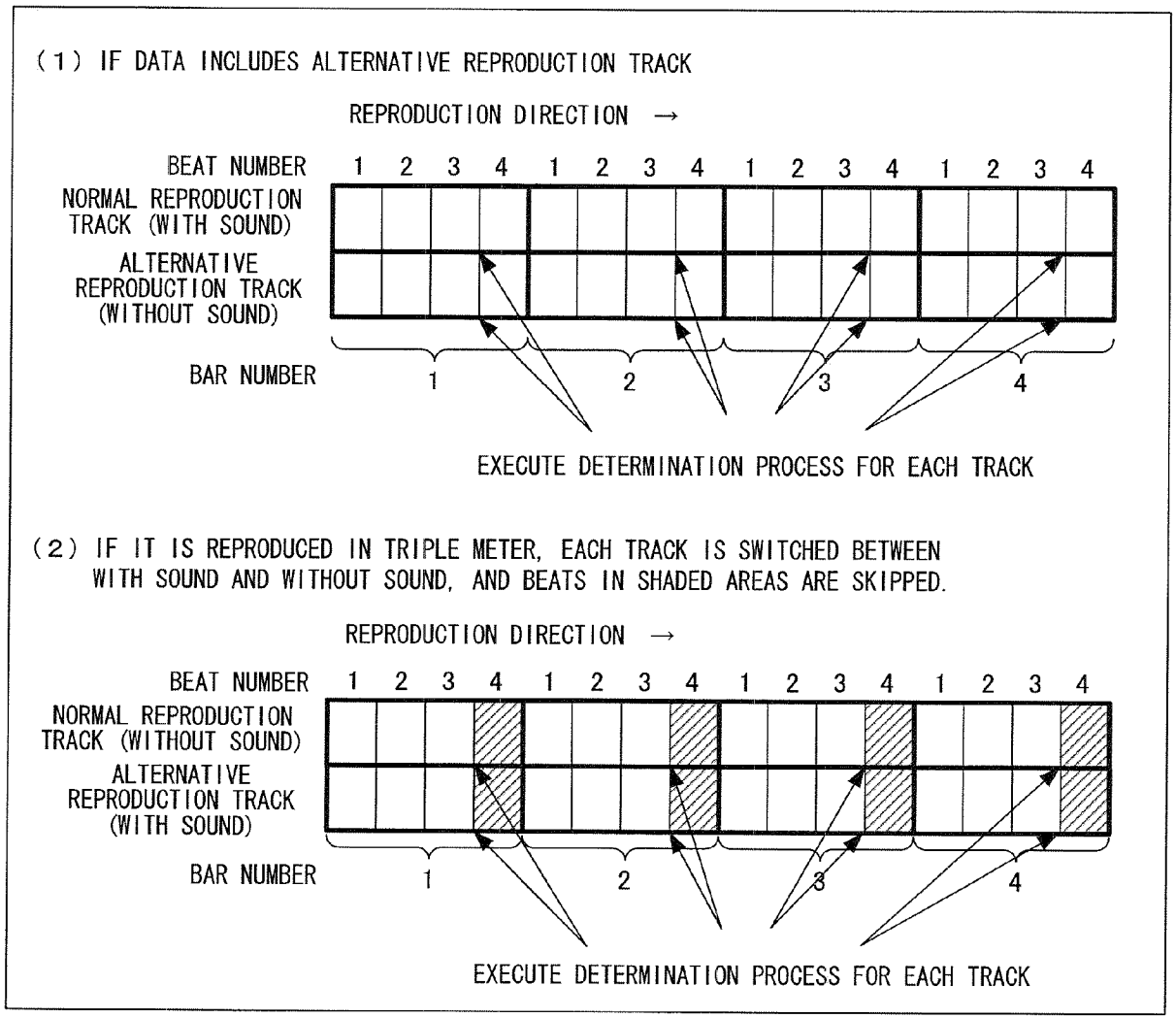
FIG. 9 is a schematic diagram showing a non-limiting example of the normal reproduction track and the alternative reproduction track in the case where the meter is changed.

With reference to FIG. 8 and FIG. 9, an example of meter dedicated tracks used in the case where the meter for reproduction of music is changed from quadruple meter to triple meter will be described. Music data of the present modification is composed of a normal dedicated track and an alternative reproduction track which will be described later. FIG. 8 shows a non-limiting example of musical scores for reproduction of the normal reproduction track and the alternative reproduction track. FIG. 9 is a schematic diagram showing a non-limiting example of the normal reproduction track and the alternative reproduction track in the case where the meter is changed.

Here, the normal reproduction track is music data of one track in quadruple meter, functioning as a meter dedicated track for quadruple meter. In addition, the alternative reproduction track is music data of one track in quadruple meter, functioning as a meter dedicated track for triple meter. The features of these tracks will be described with reference to FIG. 8. Score A in FIG. 8 is an example of musical score for actual reproduction of music data (MIDI data) of the normal reproduction track. Score B in FIG. 8 is an example of musical score for actual reproduction of music data (MIDI data) of the alternative reproduction track.

As shown in the score B in FIG. 8, the alternative reproduction track is music data having four beats per bar, in which the fourth beat is a rest. In addition, in the score B for reproduction of the alternative reproduction track, notes are adjusted in advance based on notes of the normal reproduction track such that, when the fourth beats are not reproduced, bars are smoothly connected, in comparison with the score A for reproduction of the normal reproduction track. For example, as shown in FIG. 8, in the normal reproduction track, the length of a note of the third beat in the first bar is 1.5 beats (see the score A), whereas in the alternative reproduction track, the length of a note of the third beat in the first bar is adjusted to 1 beat (see the score B). That is, the alternative reproduction track is the one adjusted such that, when the music is reproduced in triple meter (when the music is reproduced the fourth beat being skipped), bars are smoothly connected while the melody of the normal reproduction track is maintained. Thus, when a note of the fourth beat is not reproduced, the alternative reproduction track realizes smoother connection between bars than the normal reproduction track. In the above description, in the alternative reproduction track, a note of the fourth beat is a rest. However, a note of the fourth beat may be other than a rest because it is skipped.

MIDI events included in MIDI data of the normal reproduction track, and MIDI events included in MIDI data of the alternative reproduction track are executed in parallel by the music reproduction program, in order from the top. Thus, these tracks are reproduced while the same bars and the same beats are synchronized with each other. Here, if the meter for reproduction of music is set at quadruple meter, the normal reproduction track is reproduced with sound, and the alternative reproduction track is reproduced without sound. Therefore, when the meter is quadruple meter, a game player can only hear the sound of the normal reproduction track. Then, if the music data in quadruple meter is to be reproduced in triple meter in accordance with change in the situation of a game, the normal reproduction track is reproduced without sound, and the alternative reproduction track is reproduced with sound.

That is, although the normal reproduction track and the alternative reproduction track are reproduced in parallel at the same time, only one of them is reproduced with sound in accordance with change in the situation of a game.

In this case, the previously-described determination program is executed for both the normal reproduction track and the alternative reproduction track at the same timing. More specifically, as described above, since the normal reproduction track and the alternative reproduction track are reproduced while the same bars and the same beats are synchronized with each other, if the determination program is executed just before reproduction of the same beats in these tracks, the determination program for the normal reproduction track, and the determination program for the alternative reproduction track are also synchronized with each other. For example, as shown in Part (1) of FIG. 9, if music data composed of the normal reproduction track and the alternative reproduction track in quadruple meter is reproduced in triple meter ($R=3$), the determination program is executed at least just before reproduction of the fourth beats ($n=4$) in these tracks.

Then, as a result of the execution of the determination program, $n>R$ is determined with respect to each track. Therefore, in each track, it is determined that the first beat in the next bar is to be reproduced, so that the first beats in the next bars of these tracks are reproduced at the same timing. Here, when the music data in quadruple meter is reproduced in triple meter, the normal reproduction track is reproduced without sound, and the alternative reproduction track is reproduced with sound (see Part (2) of FIG. 9). Therefore, since a game player hears music based on the alternative reproduction track in which the fourth beats are not reproduced, the music sounds such that bars are more smoothly connected than in the case where a game player hears music based on the normal reproduction track in which the fourth beats are not reproduced. In addition, since both the alternative reproduction track and the normal reproduction track are reproduced while the fourth beats are not reproduced (the fourth beats are skipped), no difference in the positions of reproduction of bars or beats occurs between these tracks. Therefore, when the music that has been reproduced in triple meter has returned to quadruple meter, and the normal reproduction track is reproduced with sound and the alternative reproduction track is reproduced without sound, a game player can hear music based on the normal reproduction track in quadruple meter without any difference in such reproduction positions.

(Modification of Meter Setting Process)

Figure 10:
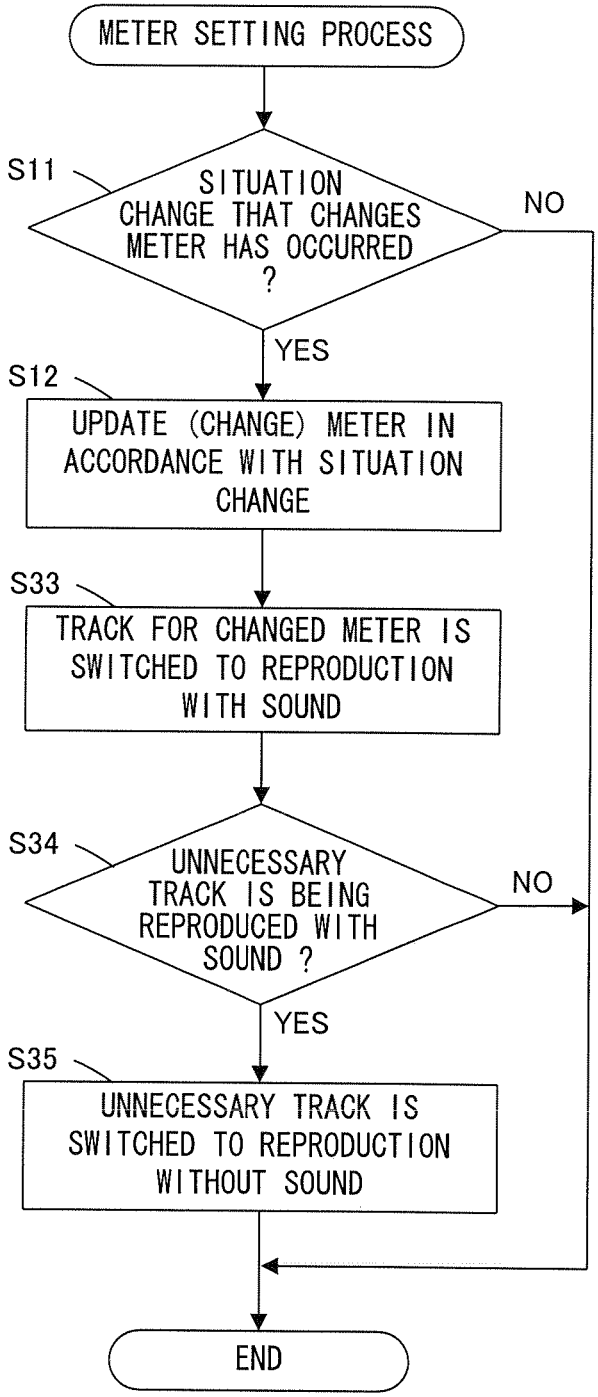
FIG. 10 shows a non-limiting example of modifications of the flowchart of the meter setting process.

Next, with reference to FIG. 10, a modification of the meter setting process executed by the processor 18 of the information processing apparatus 14 will be described. In FIG. 10, the same steps as those in the flowchart of the meter setting process shown in FIG. 6 will be denoted by the same reference numerals, and the description thereof will be simplified.

The information processing apparatus 14 is powered on, the main memory 22 is initialized, and then various programs and various data are loaded from the external storage apparatus 24 or the like to the main memory 22. Then, the processor 18 reads the meter setting program 221, and executes a process of a flowchart shown in FIG. 10 every frame (for example, every 1/60 sec). In addition, at the same time, the processor 18 reads the music reproduction program 222, thereby reproducing a normal reproduction track (for example, track for quadruple meter reproduction) with sound, and reproducing an alternative reproduction track (for example, track for triple meter reproduction) without sound.

In step S11, if the processor 18 has determined not to change the meter of music, the process ends here. If the processor 18 has determined to change the meter of music, the process proceeds to step S12, and the processor 18 updates the meter data 225 to an appropriate value. Then, the process proceeds to step S33.

In step S33, the processor 18 switches the alternative reproduction track from reproduction without sound to reproduction with sound. Then, the process proceeds to step S34.

In step S34, the processor 18 determines whether or not an unnecessary track is being reproduced with sound. Specifically, the processor 18 determines whether or not the normal reproduction track is being reproduced with sound. If the result of the determination is YES, the process proceeds to step S35. If the result of the determination is NO, the process ends here.

In step S35, the processor 18 switches the unnecessary track to reproduction without sound. Specifically, the processor 18 switches the normal reproduction track to reproduction without sound, and the process ends here.

It is preferable that in steps S33 to S35, the switching of each of the normal reproduction track and the alternative reproduction track between reproduction with sound and reproduction without sound is executed by cross-fading of reproduction volume.

(Other Modifications)

In the above embodiment, the music reproduction program and the determination program are separate programs, and the determination program is periodically executed during execution of the music reproduction program. However, the determination program may be included as a part of the music reproduction program. That is, the music reproduction program may execute the determination process (determination command) which is provided at regular intervals among MIDI events, while executing the MIDI events. For example, a command indicating that "if R is smaller than 3, the process jumps to the top MIDI event in the next bar" may be provided just before the first MIDI event in the third beat in each bar of the MIDI data, and a command indicating that "if R is smaller than 4, the process jumps to the top MIDI event in the next bar" may be provided just before the first MIDI event in the fourth beat in each bar, whereby the music reproduction program may reproduce MIDI data in accordance with the commands.

In addition, in the above embodiment, the meter for reproduction of game music is changed in accordance with change in the scene or the situation of a game, whereby a sense of realism of the game is enhanced. However, instead, the meter for reproduction of game music may be changed based on an operation by a game player (user), for example. Specifically, a game player controls a player character in a game world by using the operation apparatus 12. Here, different meters may be assigned to respective areas in the game world. Then, when the player character moves from one area to another area in accordance with an operation by the game player, the meter of game music that is currently being reproduced may be changed.

In addition, in the above embodiment, the meter for reproduction of game music is changed in accordance with change in the scene or the situation of a game. However, in addition to meter, the tone color, the tempo, or the like for reproduction of the game music may be changed.

In addition, in the above embodiment, data type of game music is MIDI data. However, instead of MIDI data or in combination of MIDI data, waveform data may be used as data of game music. In this case, since the waveform data specifies the relationship between time and frequency, the order of bars and the order of beats of music are calculated by time counting. Based on information about the counted time, the determination process program is executed at a predetermined timing (for example, just before reproduction of the fourth beat).

In addition, in the above modification, music data is composed of the normal reproduction track and the alternative reproduction track, and one of these tracks is reproduced with sound. However, music data may have a constant reproduction track which is always reproduced irrespective of change in the meter, in addition to those tracks. In this case, it is preferable that the constant reproduction track has a monotonous tone so as to be hardly influenced by change in the meter.

In addition, in the above modification, music data is composed of a pair of tracks of the normal reproduction track (meter dedicated track for quadruple meter) and the alternative reproduction track (meter dedicated track for triple meter) in which notes are adjusted in advance based on notes of the normal reproduction track. However, music data may be composed of a plurality of meter dedicated tracks for quadruple meter, and a plurality of meter dedicated tracks for triple meter in which notes are adjusted in advance based on notes of the respective normal reproduction tracks.

In addition, in the above embodiment, a game system has been described as an example of information processing systems. However, other information processing systems or information processing apparatuses may be used. For example, another information processing apparatus using music data such as a personal computer or a music performing apparatus may be used.

In addition, in the above embodiment, each of the above processes is executed by one information processing apparatus 14. However, a plurality of apparatuses that are communicable with each other by wire or wirelessly may cooperate to execute the above process.

In addition, the shape or the constituent elements of the information processing apparatus 14 described in the above embodiment is merely an example. The information processing apparatus 14 may have another shape or other constituent elements. The order of steps, the setting values, values used in the determinations, and the like for the above information processes are merely examples. Another order of steps or other values may be used.

In addition, in the above embodiment, the information processing programs to be executed by the information processing apparatus 14 are supplied to the information processing apparatus 14 via a storage medium such as the main memory 22. However, the information processing programs may be supplied to the information processing apparatus 14 by wire or wirelessly. In addition, the information processing programs may be stored in advance in a nonvolatile storage device inside the information processing apparatus 14. It is noted that instead of a nonvolatile storage memory, a CD-ROM, a DVD, a similar optical disc storage medium, a flexible disc, a hard disc, an optical magnetic disc, a magnetic tape, or the like may be used as an information storage medium for storing the wireless communication program. In addition, a volatile memory for temporarily storing the wireless communication program may be used as an information storage medium for storing the wireless communication program.

While the exemplary embodiments have been described in detail, the foregoing description is in all aspects illustrative and not restrictive. It will be understood that numerous other modifications and variations can be devised.

What is claimed is:

1. A non-transitory computer-readable storage medium having stored therein an information processing program which is executed by a computer of an information processing apparatus that reproduces music composed of one or more tracks, the information processing program causing the computer to function as:

a reproduction section configured to reproduce the music;

a meter change section configured to change the meter for reproduction of the music, while the reproduction section is reproducing the music; and a determination section configured to, based on the meter that has been changed, repeatedly determine whether or not to cause the reproduction section to reproduce the next beat supposed to be reproduced in a bar of the music that is currently being reproduced, the reproduction section reproducing the music, based on the result of the determination by the determination section.

2. The non-transitory computer-readable storage medium having stored therein the information processing program according to claim 1, wherein the music includes a first meter track and a second meter track, and the reproduction section if the meter changed by the meter change section is a first meter, reproduces the first meter track with sound and reproduces the second meter track without sound, and if the meter changed by the meter change section is a second meter which is different from the first meter, reproduces the first meter track without sound and reproduces the second meter track with sound.

3. The non-transitory computer-readable storage medium having stored therein the information processing program according to claim 2, wherein the second meter track is a track generated by adjusting the same melody as that of the first meter track so as to correspond to the second meter.

4. The non-transitory computer-readable storage medium having stored therein the information processing program according to claim 2, wherein the number of the first meter is larger than the number of the second meter.

5. The non-transitory computer-readable storage medium having stored therein the information processing program according to claim 1, wherein the reproduction section if the result of the determination by the determination section is negative, does not reproduce the next beat supposed to be reproduced, and if the result of the determination by the determination section is positive, reproduces the next beat supposed to be reproduced.

6. The non-transitory computer-readable storage medium having stored therein the information processing program according to claim 1, wherein the determination section if the number of the next beat supposed to be reproduced in a bar is equal to or smaller than the number of the meter changed by the meter change section, determines to cause the reproduction section to reproduce the next beat supposed to be reproduced, and if the number of the next beat supposed to be reproduced in a bar is larger than the number of the meter changed by the meter change section, determines not to cause the reproduction section to reproduce the next beat supposed to be reproduced.

7. The non-transitory computer-readable storage medium having stored therein the information processing program according to claim 6, wherein if the result of the determination by the determination section is negative, the reproduction section starts to reproduce the first beat in the next bar.

8. The non-transitory computer-readable storage medium having stored therein the information processing program according to claim 1, wherein the determination section repeatedly conducts the determination at a predetermined interval.

9. The non-transitory computer-readable storage medium having stored therein the information processing program according to claim 8, wherein the predetermined interval is equal to or shorter than the interval between predetermined beats in bars.

10. The non-transitory computer-readable storage medium having stored therein the information processing program according to claim 2, wherein when the meter is switched between the first meter and the second meter by the meter change section, the reproduction section switches reproduction of each of the first meter track and the second meter track between reproduction with sound and reproduction without sound, by cross-fading.

11. The non-transitory computer-readable storage medium having stored therein the information processing program according to claim 1, the information processing program further causing the computer to function as:

an input accepting section configured to accept an input from a user, wherein the meter change section changes the meter for reproduction of the music, based on the input from the user accepted by the input accepting section.

12. The non-transitory computer-readable storage medium having stored therein the information processing program according to claim 11, wherein the input from the user accepted by the input accepting section is used for processing other than the processing of changing the meter for reproduction of the music.

13. An information processing apparatus that reproduces music composed of one or more tracks, the information processing apparatus comprising:

a reproduction section configured to reproduce the music;

a meter change section configured to change the meter for reproduction of the music, while the reproduction section is reproducing the music; and a determination section configured to, based on the meter that has been changed, repeatedly determine whether or not to cause the reproduction section to reproduce the next beat supposed to be reproduced in a bar of the music that is currently being reproduced, the reproduction section reproducing the music, based on the result of the determination by the determination section.

14. An information processing system that reproduces music composed of one or more tracks, the information processing system comprising:

a computer system, comprising at least one computer processor, configured to:

reproduce the music;

change the meter for reproduction of the music, while the music is being reproduced; and based on the meter that has been changed, repeatedly determine whether or not the next beat supposed to be reproduced in a bar of the music that is currently being reproduced is to be reproduced, reproducing the music, based on the result of the determination.

15. An information processing method for reproducing music composed of one or more tracks, the information processing method comprising:

reproducing the music;

changing the meter for reproduction of the music, while the reproduction step is reproducing the music; and based on the meter that has been changed, repeatedly determining, using at least one computer processor, whether or not the next beat supposed to be reproduced in a bar of the music that is currently being reproduced is to be reproduced in the reproduction step, the reproduction step reproducing the music, based on the result of the determination in the determination step.

* * * * *